US010699546B2

(12) United States Patent
Kumar et al.

(10) Patent No.: US 10,699,546 B2
(45) Date of Patent: Jun. 30, 2020

(54) HEADPHONE AND HEADPHONE SAFETY DEVICE FOR ALERTING USER FROM IMPENDING HAZARD, AND METHOD THEREOF

(71) Applicant: Wipro Limited, Bangalore (IN)

(72) Inventors: Vijay Kumar, Bangalore (IN); Thomas Chittakattu Ninan, Kannur District (IN); Shagun Rai, Allahabad (IN)

(73) Assignee: Wipro Limited, Bangalore (IN)

( * ) Notice: Subject to any disclaimer, the term of this patent is extended or adjusted under 35 U.S.C. 154(b) by 269 days.

(21) Appl. No.: 15/667,275

(22) Filed: Aug. 2, 2017

(65) Prior Publication Data

US 2018/0365982 A1 Dec. 20, 2018

(30) Foreign Application Priority Data

Jun. 14, 2017 (IN) ..... 201741020802

(51) Int. Cl.

| | |
|---|---|
| ***G08B 21/02*** | (2006.01) |
| ***H04R 1/10*** | (2006.01) |
| ***G08B 3/10*** | (2006.01) |
| ***G08G 1/16*** | (2006.01) |
| ***G08G 1/005*** | (2006.01) |

(52) U.S. Cl.

CPC ..... *G08B 21/02* (2013.01); *G08B 3/10* (2013.01); *G08G 1/005* (2013.01); *G08G 1/166* (2013.01); *H04R 1/10* (2013.01); *H04R 1/1041* (2013.01); *H04R 2420/01* (2013.01); *H04R 2460/00* (2013.01); *H04R 2460/07* (2013.01)

(58) Field of Classification Search

CPC ..... G08B 3/10; G08B 21/02; G08G 1/005; G08G 1/166; H04R 1/1041; H04R 1/10; H04R 2420/01; H04R 2460/07; H04R 2460/00

See application file for complete search history.

(56) References Cited

U.S. PATENT DOCUMENTS

| | | | | |
|---|---|---|---|---|
| 6,236,933 | B1 | 5/2001 | Lang | |
| 8,253,589 | B2 * | 8/2012 | Grimm | G01S 5/0072 340/539.1 |
| 9,788,101 | B2 * | 10/2017 | Chizi | G08B 3/10 |
| 9,961,435 | B1 * | 5/2018 | Goyal | H04R 1/1083 |
| 10,026,309 | B1 * | 7/2018 | Nepomuceno | G08G 1/166 |
| 10,403,141 | B2 * | 9/2019 | Patil | G08G 1/166 |
| 10,506,838 | B2 * | 12/2019 | Tammam | G08G 1/167 |
| 2008/0015463 | A1 | 1/2008 | Goldstein | |

(Continued)

*Primary Examiner* — Peter D Nolan

(74) *Attorney, Agent, or Firm* — Finnegan, Henderson, Farabow, Garrett & Dunner, LLP

(57) ABSTRACT

This disclosure relates generally to electronic devices, and more particularly to headphone and headphone safety device for alerting user from impending hazard, and method thereof. In one embodiment, a method is provided for alerting a user wearing a headphone from an impending hazard. The method includes detecting a movement of the user while wearing the headphone, and upon detection, sensing a plurality of ambient parameters with respect to an external surrounding of the user. The method further includes analyzing the plurality of ambient parameters to determine the impending hazard, and upon determination, alerting the user of the impending hazard.

12 Claims, 4 Drawing Sheets

(56) References Cited

U.S. PATENT DOCUMENTS

| | | | | |
|---|---|---|---|---|
| 2010/0290636 | A1* | 11/2010 | Mao | H04S 7/304 381/74 |
| 2011/0090093 | A1* | 4/2011 | Grimm | G01S 5/0072 340/901 |
| 2015/0104041 | A1* | 4/2015 | Kulavik | H04R 1/1041 381/107 |
| 2016/0292997 | A1* | 10/2016 | Milne | G08G 1/005 |
| 2017/0188129 | A1* | 6/2017 | Sindia | H04R 1/1041 |
| 2017/0309149 | A1* | 10/2017 | Kaura | G08B 3/00 |
| 2017/0354196 | A1* | 12/2017 | Tammam | G08G 1/166 |
| 2018/0053413 | A1* | 2/2018 | Patil | G01S 11/14 |
| 2018/0365982 | A1* | 12/2018 | Kumar | G08G 1/01 |

* cited by examiner

HEADPHONE AND HEADPHONE SAFETY DEVICE FOR ALERTING USER FROM IMPENDING HAZARD, AND METHOD THEREOF

This application claims the benefit of Indian Patent Application Serial No. 201741020802, filed Jun. 14, 2017, which is hereby incorporated by reference in its entirety.

FIELD

This disclosure relates generally to electronic devices, and more particularly to headphone and headphone safety device for alerting user from impending hazard, and method thereof.

BACKGROUND

Portable auditory electronic devices, including, for example, laptops, tablet devices, mobile phones, smart phones, portable media players, portable gaming consoles, and so forth have become ubiquitous in today's world and are used extensively by users in their daily life. Typically, the portable auditory electronic devices are paired with headphones for convenience, privacy, and clarity. With increasing data connectivity and storage volume, and consequently easy access to various media, users use headphones along with their portable auditory electronic devices almost everywhere. However, headphones may adversely affect the safety of the users, particularly when they are used in open, because of a lack of awareness the users may have with their environment. For example, the users may be generally unaware of the sounds in the surroundings, miss the attention of vehicles or other hazardous situations, and end up in accidents.

The advent of noise cancelling headphones have further accentuated the problem. In some cases, noise cancelling headphones are so effective that anything apart from the sound coming from the connected devices are suppressed, and a person may not be able to hear oncoming traffic or pay attention to people around them. There is also a general danger that audio (e.g., music) in headphones may distract the user and lead to dangerous situations.

SUMMARY

In one embodiment, a method, for alerting a user wearing a headphone from an impending hazard, is disclosed. In one example, the method includes detecting a movement of the user while wearing the headphone. Upon detection, the method further includes sensing a plurality of ambient parameters with respect to an external surrounding of the user. The method further includes analyzing the plurality of ambient parameters to determine the impending hazard. Upon determination, the method further includes alerting the user of the impending hazard.

In one embodiment, a headphone safety device, for alerting a user wearing a headphone from an impending hazard, is disclosed. In one example, the headphone safety device includes one or more initiation sensors for sensing one or more initiation parameters. The headphone safety device further includes a plurality of ambient sensors for sensing a plurality of ambient parameters with respect to an external surrounding of the user. The headphone safety device further includes an intelligent unit in communication with the one or more initiation sensors and the plurality of ambient sensors. The intelligent unit is configured to detect a movement of the user while wearing the headphone based on the one or more initiation parameters, and, upon detection, activate the plurality of ambient sensors for sensing the plurality of ambient parameters. The intelligent unit is configured to analyze the plurality of ambient parameters to determine the impending hazard, and, upon determination, alert the user of the impending hazard.

In one embodiment, a headphone, for alerting a user from an impending hazard, is disclosed. In one example, the headphone includes a pair of speakers adapted to play an incoming audio. The headphone further includes one or more initiation sensors for sensing one or more initiation parameters. The headphone further includes a plurality of ambient sensors for sensing a plurality of ambient parameters with respect to an external surrounding of the user. The headphone further includes a controller adapted to control the pair of speakers. The headphone further includes an intelligent unit in communication with the one or more initiation sensors, the plurality of ambient sensors, and the controller. The intelligent unit is configured to detect a movement of the user while wearing the headphone based on the one or more initiation parameters, and, upon detection, activate the plurality of ambient sensors for sensing the plurality of ambient parameters. The intelligent unit is configured to analyze the plurality of ambient parameters to determine the impending hazard, and, upon determination, activate the controller to alert the user of the impending hazard.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims.

Figure 1A:
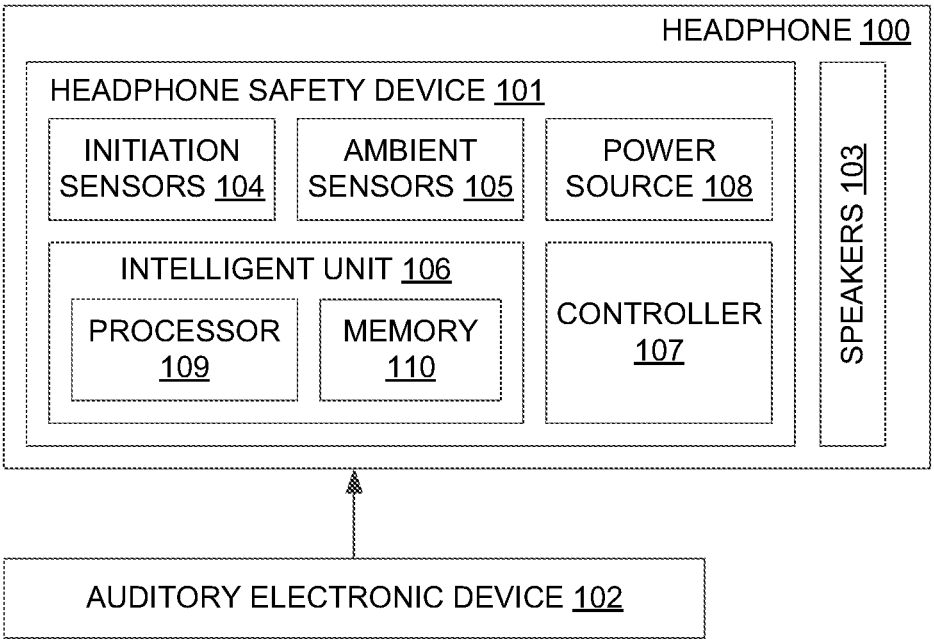
FIGS. 1A and 1B are block diagrams of an exemplary headphone and an exemplary headphone safety device in accordance with some embodiments of the present disclosure.
Figure 1B:
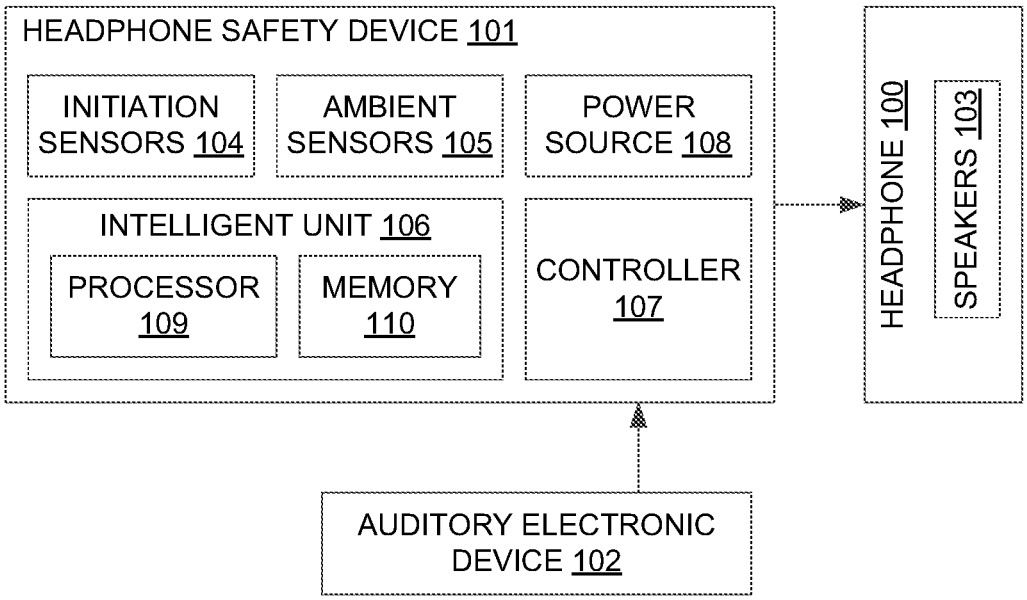

Referring now to FIGS. 1A and 1B, block diagrams of an exemplary headphone 100 and an exemplary headphone safety device 101 is illustrated in accordance with some embodiments of the present disclosure. As illustrated, variations of headphone 100 and headphone safety device 101 may be used for implementing various embodiments of disclosed methods for alerting a user wearing the headphone 100 from an impending hazard. For example, as illustrated in FIG. 1A, in some embodiments, the headphone safety device 101 may be a part of the headphone 100. Alternatively, as illustrated in FIG. 1B, in some embodiments, the headphone safety device 101 may be a separate device that may be coupled to the headphone 100 by the user either directly using a cord, or using short range wireless technology such as Bluetooth, Zigbee, FM radio, and so forth.

The headphone 100 may include, but is not limited to, a circumaural or over ear headphones, supra-aural headphones, and headset. The headphone 100 or the headphone safety device 101 may be capable of coupling with any of the auditory electronic devices 102 either directly using a cord, or using short range wireless technology such as Bluetooth, Zigbee, FM radio, and so forth. Thus, in the embodiment illustrated in FIG. 1A, the auditory electronic devices 102 may be coupled with the headphone 100. Similarly, in the embodiment illustrated in FIG. 1B, the auditory electronic devices 102 may be coupled with the headphone safety device 101, which in turn may be coupled with the headphone 100. The auditory electronic devices 102 may include, but is not limited to, a laptop, a notebook, a tablet device, a mobile phone, a smart phone, a portable media player, a portable gaming console, radio, electronic musical instrument, and a smart watch. Upon coupling, the headphone 100 may reproduce the incoming audio signal from the auditory electronic devices 102 via the speakers 103.

The headphone safety device 101 alerts the user wearing the headphone 100 from the impending hazard in accordance with some embodiments of the present disclosure. For example, the headphone safety device 101 detects a movement of the user while wearing the headphone, and, upon detection, senses a plurality of ambient parameters with respect to an external surrounding of the user. The headphone safety device 101 further analyzes the plurality of ambient parameters to determine the impending hazard, and, upon determination, alerts the user of the impending hazard. In some embodiments, the headphone safety device 101 may include initiation sensors 104, ambient sensors 105, an intelligent unit 106, a controller 107, and a power source 108.

The initiation sensors 104 acquire or sense various initiation parameters. The initiation sensors 104 may include, but are not limited to, motion sensors (e.g., a gyroscope, an accelerometer, a magnetometer, etc.), a proximity sensor, and a touch sensor. In some embodiments, the motion sensors such as the gyroscope, the accelerometer, and the magnetometer may be embodied in an inertial measurement unit (IMU). The initiation parameters may include, but are not limited to, a stretching of the headphone while wearing, a proximity of user with respect to the headphone, a movement of ear/facial muscles in contact with the headphone. These parameters enables the headphone safety device 101 to detect if the user is wearing the headphone. Additionally, the initiation parameters may also include a movement of the user while wearing the headphone as well as a direction of the movement of the user. It should be noted that, in some embodiments, the data with respect to user movement is acquired and analyzed only when it is determined that the user is wearing the headphone.

The ambient sensors 105 acquires or senses various ambient parameters with respect to an external surrounding of the user. In some embodiments, the ambient sensors 105 may be triggered or activated upon detection of the of the initiation parameters. For example, the ambient sensors 105 may be triggered upon detection of the movement of the user while wearing the headphone 100. The ambient sensors 105 may include, but are not limited to, a geo-positioning device (GPS), a light detection and ranging sensor (LIDAR), an infrared sensor, a proximity sensor, an ultrasonic sensor, a short-range radar sensor, a camera, and a microphone. The ambient parameters may include, but are not limited to, a location of the user, a direction of movement of the user, a moving vehicle, a hazardous object, an approach of the moving vehicle or the hazardous object with respect to the user, a proximity of the moving vehicle or the hazardous object with respect to the user, a video of the environment, and an ambient sound. These parameters enables the headphone safety device 101 to determine the impending hazard if any.

The intelligent unit 106 includes a processor 109 and a memory 110. The processor 109 may execute various instructions to carry out various system-generated requests and to carry out various functions of the headphone safety device 101. The processor 109 may include, but are not limited to, application-specific integrated circuits (ASICs), digital signal processors (DSPs), Field Programmable Gate Arrays (FPGAs), etc. The memory 110 stores instructions that, when executed by the processor 109, cause the processor 109 to perform various functions of the headphone safety device 101. For example, the memory 110 may store a set of instructions corresponding to various components and modules of the headphone safety device 101. The processor 109 may fetch the instructions from the memory 110, and execute them to perform various functions of the headphone safety device 101. In some embodiments, the memory 110 may stores a set of instructions or algorithms which is executed by the processor 109 to detect a movement of the user while wearing the headphone, to sense a plurality of ambient parameters with respect to an external surrounding of the user, to analyze the plurality of ambient parameters to determine the impending hazard, and to alert the user of the impending hazard.

The intelligent unit 106 is in communication with various sensors (i.e., the initiation sensors 104 and the ambient sensors 105) so as to receive various sensor parameters (i.e., the initiation parameters and the ambient parameters). The intelligent unit 106 may then process and analyze the sensor parameters. For example, the intelligent unit 106 may process and analyze the initiation parameters so as to detect a movement of the user while wearing the headphone. Upon detection, the intelligent unit 106 may trigger or activate the ambient sensors 105. Further, the intelligent unit 106 may process and analyze the ambient parameters so as to determine the impending hazard. Additionally, the intelligent unit 106 is in communication with the controller 107. Thus, upon determination of the impending hazard, the intelligent unit 106 may pass a control signal to trigger or activate the controller in order to alert the user of the impending hazard.

In some embodiments, the intelligent unit 106 analyzes the ambient parameters by correlating a set of ambient parameters. For example, in some embodiments, the intelligent unit 106 may correlate the location of the user (e.g., in high traffic area) or the direction of movement of the user (e.g., crossing of road), and the moving vehicle (e.g., approaching vehicle) or the hazardous object (e.g., an obstacle warning the user) so as to determine the impending hazard. Alternatively, in some embodiments, the intelligent unit 106 may correlate the moving vehicle or the hazardous object, and the ambient sound (e.g., high pitch sound alerting the user to watch out). Further, in some embodiments, the intelligent unit 106 may correlate each of the above mentioned parameters so as to determine the impending hazard. In other words, the intelligent unit 106 may correlate the location of the user or the direction of movement of the user, the moving vehicle or the hazardous object, and the ambient sound.

By way of example, the intelligent unit 106 analyzes the ambient parameters by determining a vehicular traffic based on the location of the user, and, upon determination of the vehicular traffic, by determining the moving vehicle or the hazardous object approaching towards the user. By way of another example, the intelligent unit 106 analyzes the ambient parameters by determining a crossing of a road by the user based on the location of the user and the direction of movement of the user, and, upon determination of the crossing of the road by the user, determining the moving vehicle or the hazardous object approaching towards the user. In both of the above examples, the intelligent unit 106 may optionally determine a high-pitch sound to alert the user based on the ambient sound.

The controller 107 controls the input to the speakers 103 of the headphone 100 based on the control signal from the intelligent unit 106. Thus, the controller 107 may provide an alert to the user of the impending hazard upon receipt of the control signal from the intelligent unit 106. In some embodiments, the controller 107 may provide the alert by playing a pre-defined audio notification (e.g., 'be careful you are approaching a heavy traffic zone', 'watch your steps in construction zone', etc.) to the user, or by playing an ambient noise (e.g., honking, shouting, traffic noise, etc.) captured by the microphone to the user. In some embodiments, the ambient noise captured by the microphone may be amplified by an amplifier. In some embodiments, the controller 107 may allow the incoming audio from the auditory electronic device 102 in normal circumstances, and may interrupt the same upon receipt of the control signal so as to provide the alert to the user.

The power source 108 provides power to various components of the headphone safety device 101 through an internal or an external power source via a power circuitry. The internal power source may be a fixed or a removal rechargeable battery (e.g., Lithium-ion battery, Nickel metal hydride battery, etc.). The external source may be a direct current source (e.g., portable power bank comprising of rechargeable battery), or a charger adaptor operating from an alternating current source (e.g., power socket).

It should be noted that the some of the components (e.g., intelligent unit 106, controller 107, etc.) of the headphone safety device 101 may be implemented in programmable hardware devices such as programmable gate arrays, programmable array logic, programmable logic devices, and so forth. Alternatively, these components may be implemented in software for execution by various types of processors. An identified engine of executable code may, for instance, include one or more physical or logical blocks of computer instructions which may, for instance, be organized as an object, procedure, function, module, or other construct. Nevertheless, the executables of an identified engine need not be physically located together, but may include disparate instructions stored in different locations which, when joined logically together, include the engine and achieve the stated purpose of the engine. Indeed, an engine of executable code could be a single instruction, or many instructions, and may even be distributed over several different code segments, among different applications, and across several memory devices.

As will be appreciated by one skilled in the art, a variety of processes may be employed for alerting the user wearing the headphone from the impending hazard. For example, the exemplary headphone 100 and the exemplary headphone safety device 101 may alert the user wearing the headphone from the impending hazard by the processes discussed herein. In particular, as will be appreciated by those of ordinary skill in the art, control logic and/or automated routines for performing the techniques and steps described herein may be implemented by the headphone 100 and the associated headphone safety device 101, either by hardware, software, or combinations of hardware and software. For example, suitable code may be accessed and executed by the one or more processors on the headphone 100 or the headphone safety device 101 to perform some or all of the techniques described herein. Similarly, application specific integrated circuits (ASICs) configured to perform some or all of the processes described herein may be included in the one or more processors on the headphone 100 or the headphone safety device 101.

Figure 2:
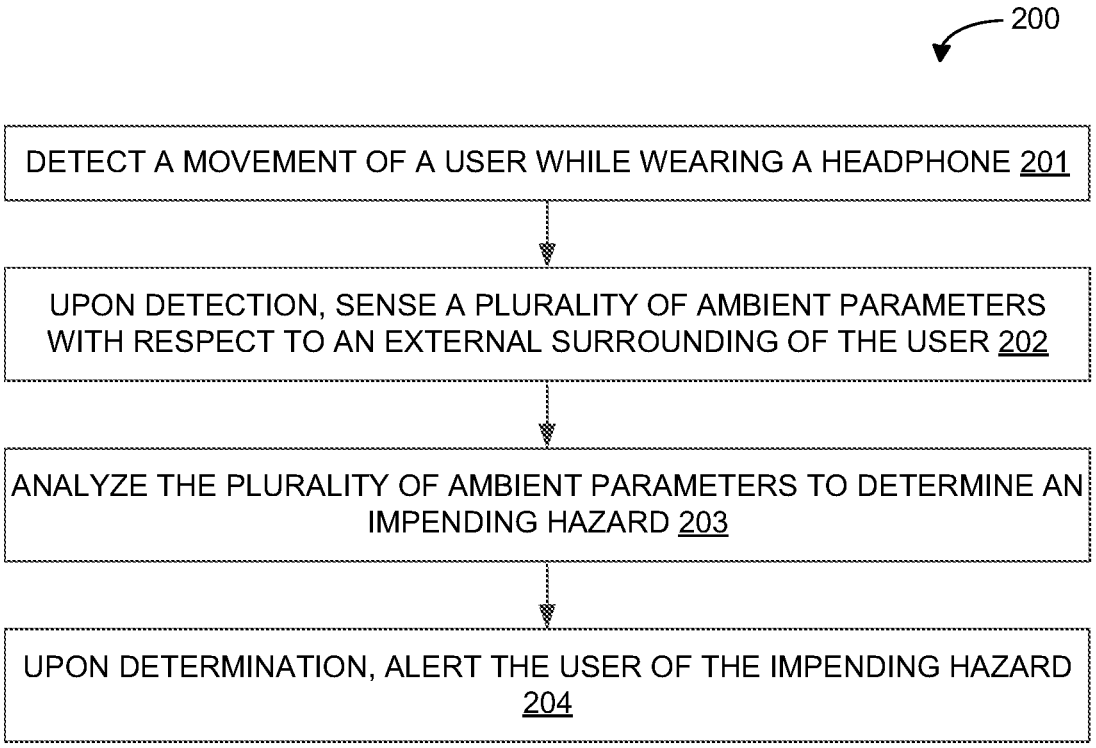
FIG. 2 is a flow diagram of an exemplary process for alerting a user wearing a headphone from an impending hazard in accordance with some embodiments of the present disclosure.

For example, referring now to FIG. 2, exemplary control logic 200 for alerting a user wearing a headphone from an impending hazard via a headphone safety device, such as device 101, is depicted via a flowchart in accordance with some embodiments of the present disclosure. As illustrated in the flowchart, the control logic 200 includes the steps of detecting a movement of the user while wearing the headphone at step 201, sensing a plurality of ambient parameters with respect to an external surrounding of the user upon detection at step 202, analyzing the plurality of ambient parameters to determine the impending hazard at step 203, and alerting the user of the impending hazard upon determination at step 204.

In some embodiments, each of the plurality of ambient parameters includes at least one of a location of the user, a direction of movement of the user, a moving vehicle, a hazardous object, and an ambient sound. Additionally, in some embodiments, analyzing the plurality of ambient parameters at step 203 includes correlating a set of the plurality of ambient parameters to determine the impending hazard. Further, in some embodiments, correlating includes one of: correlating the location of the user or the direction of movement of the user, and the moving vehicle or the hazardous object, correlating the moving vehicle or the hazardous object, and the ambient sound, and correlating the location of the user or the direction of movement of the user, the moving vehicle or the hazardous object, and the ambient sound.

In some embodiments, analyzing the plurality of ambient parameters at step 203 includes determining a vehicular traffic based on the location of the user, determining the moving vehicle or the hazardous object approaching towards the user upon determination of the vehicular traffic, and optionally determining a high-pitch sound to alert the user based on the ambient sound. Additionally, in some embodiments, analyzing the plurality of ambient parameters at step 203 includes determining a crossing of a road by the user based on the location of the user and the direction of movement of the user, determining the moving vehicle or the hazardous object approaching towards the user upon determination of the crossing of the road by the user, and optionally determining a high-pitch sound to alert the user based on the ambient sound.

In some embodiments, alerting the user at step 204 includes at least one of: playing a pre-defined audio notification to the user, and playing an ambient noise captured by the microphone to the user. Additionally, in some embodiments, the ambient noise captured by the microphone is amplified by an amplifier. Further, in some embodiments, alerting the user comprises interrupting an audio playing on the headphone.

Figure 3:
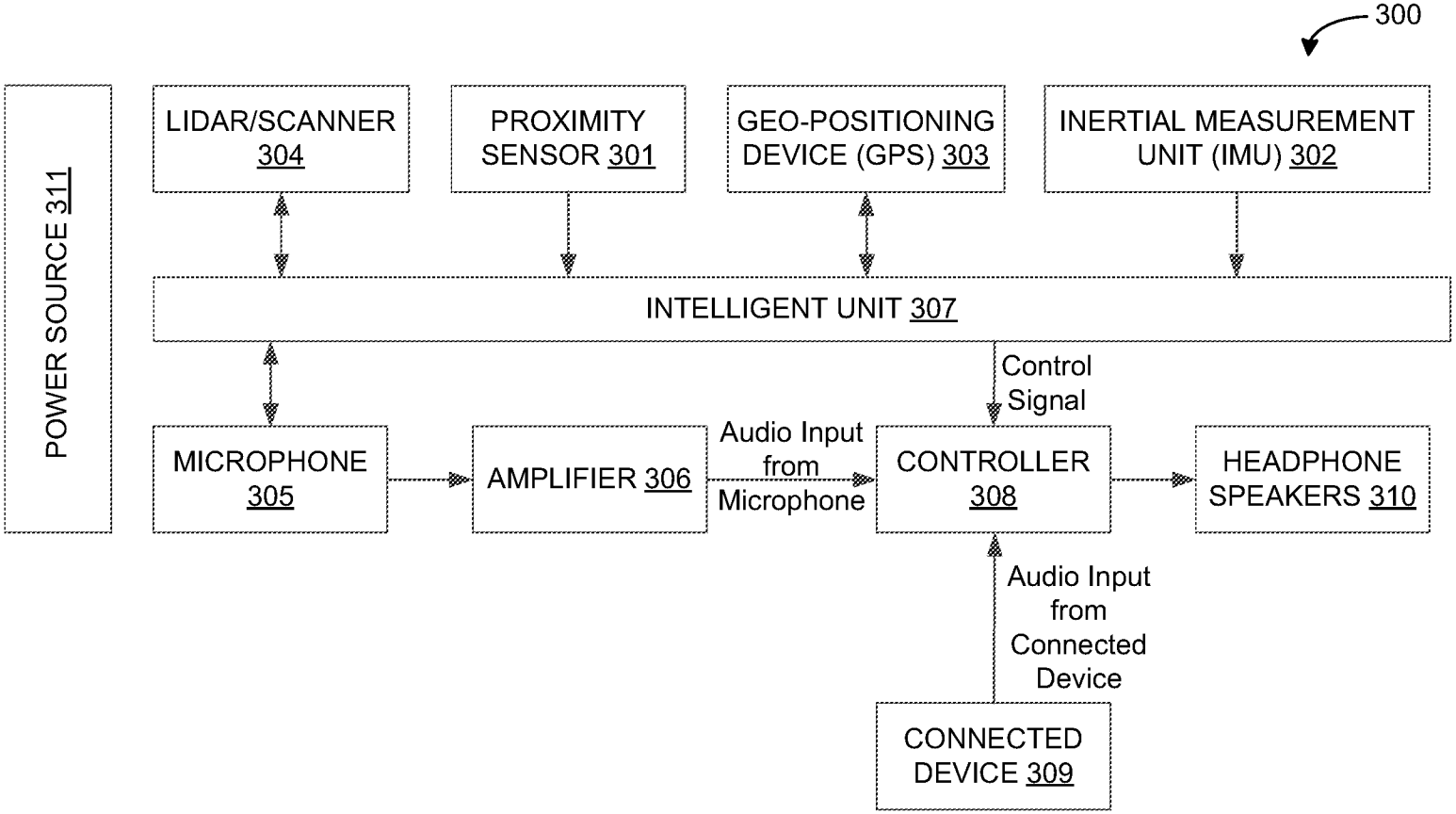
FIG. 3 is a functional block diagram of an exemplary headphone safety device in accordance with some embodiments of the present disclosure.

Referring now to FIG. 3, a functional block diagram of an exemplary headphone safety device 300 for alerting the user from the impending hazard is illustrated in accordance with some embodiments of the present disclosure. The headphone safety device 300 is analogous to the headphone safety device 101 implemented by the or for the headphone 100 of FIGS. 1A and 1B. The headphone safety device 300 may include various components or modules that perform various functions so as to detect movement of the user while wearing the headphone, to sense ambient parameters with respect to external surrounding of the user, to analyze ambient parameters to determine impending hazard, and to alert the user of the impending hazard.

In some embodiments, the headphone safety device 300 includes a proximity sensor 301 for detecting if the user is wearing the headphone, an inertial measurement unit (IMU) 302 for detecting the movement of the user while wearing the headphone (i.e., the user is wearing the headphone and walking) along with a direction of the movement, and a geo-positioning device (GPS) 303 for obtaining the information about the location of the user. The headphone safety device 300 further includes a light detection and ranging sensor (LIDAR) or a short-range radar sensor, or any other scanner or sensor (e.g. camera) 304 for detecting any moving vehicles or hazardous objects around the user. The headphone safety device 300 further includes a microphone 305 to capture the ambient noise from the external surroundings. An amplifier 306 may amplify the sounds captured by the microphone.

Additionally, the headphone safety device 300 includes an intelligent unit 307 to receive sensor data from the sensors, to analyze the sensor data, to determine any hazardous situation, and to control a controller 308 accordingly. In some embodiments, the controller 308 may be a multiplexer (MUX) so as to switch between audio input from a connected device 309, and audio input from the microphone 305 (i.e., sound from the external surroundings captured by the microphone 305 and amplified by the amplifier 306) based on the control signal received from the intelligent unit 307. The selected audio input is then reproduced via the headphone speaker 310. The headphone safety device 300 further includes a battery or a power source for powering the entire device. It should be noted that the various hardware or software based components or modules of the headphone safety device 300 may be directly connected to each other or may be indirectly connected to each other through one or more intermediate components or modules.

By way of example, a user wearing the headphone and listening to an audio from his smart phone may be walking down a street having a vehicular traffic. The proximity sensor 301 in the headphone safety device 300 may enable the intelligent unit 307 to detect if the user is wearing the headphone, while the IMU 302 may enable the intelligent unit 307 to detect if the user is wearing the headphone and walking based on the walking pattern. It should be noted that, in some embodiments, the data from IMU with respect user movement is received and analyzed by the intelligent unit only when it is determined that the user is wearing the headphone based on the data from proximity sensor. Upon detection of the user movement, the intelligent unit 307 may trigger the GPS device 303 that may provide substantially accurate information about location of the user to the intelligent unit 307. The GPS data may be also analyzed by the intelligent unit 307 to determine a vehicular traffic in the area. Upon detecting the traffic, the intelligent unit 307 may trigger LIDAR or other similar scanners 304 so as to identify any hazardous situation. The LIDAR or other similar scanners 304 may scan or video the objects around the user, and may provide the captured information to intelligent unit 307. Additionally, the microphone 305 may capture the ambient noise around the user, and may provide the captured information to the intelligent unit 307. The captured information (i.e., the inputs from LIDAR or other similar scanners, the inputs from microphone, etc.) may then be analyzed by the intelligent unit 307 to determine if there are any hazardous situation (e.g., if any moving vehicle or other objects are fast approaching the user, if there is any warning issued to the user, etc.). Thus, in an example, the hazardous situation for issuing an alert may be determined when the user is wearing the headphone (determined by analyzing the IMU sensor data), is in an area with vehicular traffic (determined by analyzing the GPS data), and a moving vehicle is approaching the user (determined by analyzing the LIDAR data) which may result in an accident.

Upon detection of a hazardous situation, the intelligent unit 307 may issue a control signal to the controller 308, which then issues an alert to the user via the headphone speaker 310. The alert may be a pre-defined audio notification, or an ambient noise captured by the microphone 305 and amplified by the amplifier 306. It should be noted that, when the headphone is in use, the controller 308 passes the audio from the connected device 309 to the headphone speakers 310. The controller 308, on receiving the control signal from the intelligent unit 307, interrupts the audio from the connected device 309 from passing to the headphone speakers 310 so as to provide alert. Instead, the controller 308 passes the ambient sound from the surroundings captured by the microphone 305, or the pre-defined audio notification to the headphone speakers 310. Thus, the user may be alerted, may be aware of the surroundings, and may take precautions to avoid any accidents.

Figure 4:
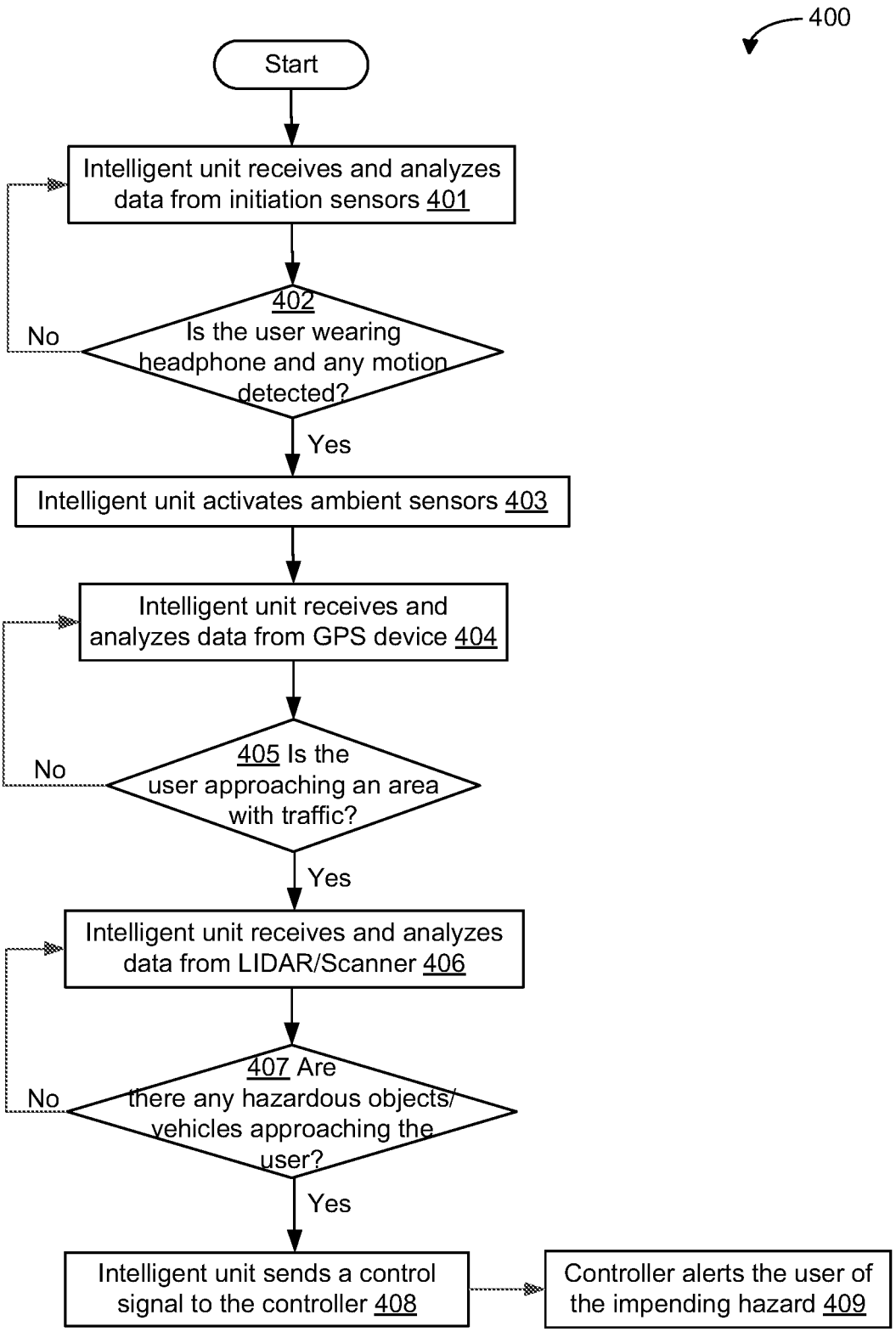
FIG. 4 is a flow diagram of a detailed exemplary process implemented by the headphone safety device of FIG. 3 for alerting a user wearing a headphone from an impending hazard in accordance with some embodiments of the present disclosure.

Referring now to FIG. 4, a detailed exemplary control logic 400 implemented by the headphone safety device 300 for alerting the user wearing the headphone from the impending hazard is depicted via a flowchart in accordance with some embodiments of the present disclosure. As illustrated in the flowchart, at step 401, the intelligent unit continuously receives and analyzes data from initiation sensors (i.e., proximity sensor and IMU). It should be noted that, in some embodiments, the data from IMU may be received and analyzed only when it is determined that the user is wearing the headphone based on the data from proximity sensor. Thus, at step 402, the intelligent unit determines if the user is wearing the headphone, and if so then if the user is moving (e.g., walking while wearing the headphone). On a negative determination, the control logic 400 flows back to step 401. However, on a positive determination (i.e., if the user is indeed walking while wearing the headphone), at step 403, the intelligent unit activates the ambient sensors.

At step 404, the intelligent unit receives and analyzes location data from the GPS device. At step 405, the intelligent unit determines if the user is approaching an area with vehicular traffic and/or if the user is about to cross a road. Upon a negative determination, the control logic 400 flows back to step 404. However, on a positive determination (i.e., if the user is indeed approaching an area with vehicular traffic and/or about to cross a road), at step 406, the intelligent unit receives and analyzes data from the LIDAR or other similar scanners. At step 407, the intelligent unit determines if there are any hazardous objects or vehicles approaching the user. Upon a negative determination, the control logic 400 flows back to step 406. However, on a positive determination (i.e., any such vehicle or any such objects are indeed detected), a hazardous situation is determined. On detecting any such hazardous situation, at step 408, the intelligent unit sends a control signal to the controller. At step 409, the controller alerts the user of the impending hazard.

The controller stops reproducing the audio from the connected device. Instead, the controller plays a pre-defined audio notification alerting the user, or passes the real sound from the surroundings to the headphone speakers, which is captured by the microphones and amplified by the amplifier. In this way, the user may hear the real sound from the surroundings in hazardous situation, may be aware of the surroundings, and may take precautions to avoid any accidents.

As will be also appreciated, at least a portion of the above described techniques may take the form of computer or controller implemented processes and apparatuses for practicing those processes. The disclosure can also be embodied in the form of computer program code containing instructions embodied in tangible media, such as floppy diskettes, CD-ROMs, hard drives, or any other computer-readable storage medium, wherein, when the computer program code is loaded into and executed by a computer or controller, the computer becomes an apparatus for practicing the invention. The disclosure may also be embodied in the form of computer program code or signal, for example, whether stored in a storage medium, loaded into and/or executed by a computer or controller, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

Further, as will be appreciated by those skilled in the art, the techniques described in the various embodiments discussed above provide for a mechanism for alerting user wearing a headphone from impending hazard, thereby improving safety of the user. The techniques described in the embodiments discussed above provide timely alerts to the user wearing the headphones on detecting a hazardous situation so as to enable the user to become aware of the surroundings and take precautionary actions. For example, the techniques enable the user to know about an approaching vehicle while crossing the road so as to enable the user to timely move away and avoid any mishap.

The specification has described headphone and headphone safety device for alerting user from impending hazard, and method thereof. The illustrated steps are set out to explain the exemplary embodiments shown, and it should be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

It is intended that the disclosure and examples be considered as exemplary only, with a true scope and spirit of disclosed embodiments being indicated by the following claims.

What is claimed is:

1. A method of alerting a user wearing a headphone from an impending hazard, the method comprising:

detecting, by a headphone safety device, a movement of the user while wearing the headphone;

upon detection, sensing, by the headphone safety device, a plurality of ambient parameters with respect to an external surrounding of the user, wherein the plurality of ambient parameters comprise a location of the user, a direction of movement of the user, an ambient sound, and at least one of a moving vehicle and a hazardous object;

analyzing, by the headphone safety device, the plurality of ambient parameters to determine the impending hazard, wherein the analysis of the plurality of ambient parameters comprises:

correlating the moving vehicle or the hazardous object, with the ambient sound in the external surrounding of the user;

correlating the location of the user and the direction of movement of the user, with a location of the moving vehicle or the hazardous object and a direction of movement of the moving vehicle or the hazardous object, and the ambient sound;

determining a vehicular traffic based on the location of the user;

upon determination of the vehicular traffic, determining that the moving vehicle or the hazardous object is approaching towards the user;

determining a high-pitch sound to alert the user based on the ambient sound; and upon determination that the moving vehicle or the hazardous object is approaching towards the user, alerting, by the headphone safety device, the user of the impending hazard.

2. The method of claim 1, wherein analyzing the plurality of ambient parameters comprises:

correlating the location of the user or the direction of movement of the user, and the moving vehicle or the hazardous object.

3. The method of claim 1, wherein analyzing the plurality of ambient parameters comprises:

determining a crossing of a road by the user based on the location of the user and the direction of movement of the user;

upon determination of the crossing of the road by the user, determining the moving vehicle or the hazardous object approaching towards the user.

4. The method of claim 1, wherein alerting the user comprises at least one of:

playing a pre-defined audio notification to the user; and playing an ambient noise captured by a microphone to the user.

5. The method of claim 4, wherein the ambient noise captured by the microphone is amplified by an amplifier.

6. The method of claim 4, wherein alerting the user comprises interrupting an audio playing on the headphone.

7. A headphone safety device for alerting a user wearing a headphone from an impending hazard, the headphone safety device comprising:

one or more initiation sensors for sensing one or more initiation parameters;

a plurality of ambient sensors for sensing a plurality of ambient parameters with respect to an external surrounding of the user;

an intelligent unit in communication with the one or more initiation sensors and the plurality of ambient sensors, wherein the intelligent unit is configured to:

detect a movement of the user while wearing the headphone based on the one or more initiation parameters;

upon detection, activate the plurality of ambient sensors for sensing the plurality of ambient parameters;

analyze the plurality of ambient parameters to determine the impending hazard, wherein the analysis of the plurality of ambient parameters comprises:

correlating a moving vehicle or a hazardous object; with the ambient sound in the external surrounding of the user;

correlating a location of the user and a direction of movement of the user with a location of the moving vehicle or the hazardous object and a direction of movement of the moving vehicle or the hazardous object, and the ambient sound; and upon determination of the impending hazard, alert the user of the impending hazard, wherein the user is alerted through a controller adapted to control speakers of the headphone, wherein the user is alerted by:

playing a pre-defined audio notification to the user; and playing an ambient noise captured by a microphone to the user.

8. The headphone safety device of claim 7, wherein the one or more initiation sensors comprises at least one of a gyroscope, an accelerometer, a magnetometer, a proximity sensor, and a touch sensor.

9. The headphone safety device of claim 7, wherein the plurality of ambient sensors comprises at least one of a geo-positioning device, a light detection and ranging sensor, an infrared sensor, a proximity sensor, an ultrasonic sensor, a short-range radar sensor, a camera, and a microphone.

10. The headphone safety device of claim 7, wherein the plurality of ambient parameters comprise the location of the user, the direction of movement of the user, the ambient sound, and at least one of the moving vehicle and the hazardous object.

11. The headphone safety device of claim 7, wherein the intelligent unit is configured to alert the user by interrupting an audio playing on the headphone.

12. A headphone for alerting a user from an impending hazard, the headphone comprising:

a pair of speakers adapted to play an incoming audio;

one or more initiation sensors for sensing one or more initiation parameters;

a plurality of ambient sensors for sensing a plurality of ambient parameters with respect to an external surrounding of the user;

a controller adapted to control the pair of speakers;

an intelligent unit in communication with the one or more initiation sensors, the plurality of ambient sensors, and the controller, wherein the intelligent unit is configured to:

detect a movement of the user while wearing the headphone based on the one or more initiation parameters;

upon detection, activate the plurality of ambient sensors for sensing the plurality of ambient parameters;

analyze the plurality of ambient parameters to determine the impending hazard, wherein the analysis of the plurality of ambient parameters comprises:

correlating a moving vehicle or a hazardous object; with the ambient sound in the external surrounding of the user;

correlating a location of the user and a direction of movement of the user with a location of the moving vehicle or the hazardous object and a direction of movement of the moving vehicle or the hazardous object, and the ambient sound; and upon determination of the impending hazard, activate the controller to alert the user of the impending hazard, wherein the user is alerted through the controller adapted to control speakers of the headphone, wherein the user is alerted by:

playing a pre-defined audio notification to the user; and playing an ambient noise captured by a microphone to the user.

* * * * *